United States Patent [19]

Pfister et al.

[11] Patent Number: 4,746,910

[45] Date of Patent: May 24, 1988

[54] PASSIVE INFRARED INTRUSION DETECTOR EMPLOYING CORRELATION ANALYSIS

[75] Inventors: Gustav Pfister, Uetikon; Peter Wägli, Breurgarten, both of Switzerland

[73] Assignee: Cerberus AG, Männedorf, Switzerland

[21] Appl. No.: 915,057

[22] Filed: Oct. 3, 1986

Related U.S. Application Data

[63] Continuation-in-part of Ser. No. 533,938, Sep. 20, 1983, abandoned.

[30] Foreign Application Priority Data

Oct. 1, 1982 [CH] Switzerland ..... 5795/82

[51] Int. Cl.[4] ..... G08B 13/18

[52] U.S. Cl. ..... 340/567; 250/340; 340/522

[58] Field of Search ..... 340/567, 552, 522; 250/340, 395

[56] References Cited

U.S. PATENT DOCUMENTS 4,382,291 5/1983 Nakauchi ..... 340/552

4,499,564 2/1985 Sirai ..... 340/552

4,512,000 4/1985 Masuko ..... 340/552

4,639,902 1/1987 Leuerance et al. ..... 340/552

*Primary Examiner*—Glen R. Swann, III

*Attorney, Agent, or Firm*—Werner W. Kleeman

[57] ABSTRACT

For reducing the susceptibility to false alarms and for increasing the detection probability of a passive infrared detector, the actual signals obtained from a first sensor element are continuously compared in a correlator with reference or set signals stored in a read-only memory and/or with the actual signals obtained from a second sensor element monitoring the near region. The correlator delivers an output signal which corresponds to the correlation of both signals which are compared with one another. An alarm signal is triggered when the correlation exceeds a predetermined value, for instance 0.7, and the amplitude has reached a predetermined threshold. The infrared detector affords high security against giving of false alarms and a high detection probability, even in the presence of signals possessing a great amount of noise, but also delivers an alarm signal in the event the detector is attempted to be sabotaged, for instance by covering the inlet optical system.

12 Claims, 3 Drawing Sheets

PASSIVE INFRARED INTRUSION DETECTOR EMPLOYING CORRELATION ANALYSIS

CROSS REFERENCE TO RELATED APPLICATION

This application is a continuation-in-part application of the copending U.S. patent application Ser. No. 06/533,938, filed Sept. 20, 1983 and entitled: "PASSIVE INFRARED DETECTOR FOR DETERMINING THE PRESENCE OF AN INTRUDER IN A MONITORED AREA", now abandoned.

BACKGROUND OF THE INVENTION

The present invention relates to a new and improved construction of a passive infrared detector for determining the presence of a body, for instance an intruder or unauthorized person in a monitored area or room.

In its more specific aspects, the present invention concerns a new and improved construction of a passive infrared detector for determining the presence of a body, typically a human being, possessing a temperature deviating from the ambient temperature. The passive infrared detector comprises at least one sensor element for generating an electrical signal as a function of infrared radiation impinging thereat, at least one optical element or system serving for focussing onto the sensor element the infrared radiation emitted by the body, as well as an evaluation circuit serving for monitoring the electrical signals outputted by the sensor element.

It is known to use infrared detectors in monitoring equipment for determining the presence of intruders in rooms or areas which are to be supervised. These infrared detectors, so-called passive-IR-detectors, are responsive to the infrared radiation emitted by a body, especially by human beings. A drawback of such infrared detectors and the presently employed wide-band sensitive sensor elements, such as pyroelectric crystals or polymers, bolometers or thermoelements, resides in the fact that these elements are responsive to electromagnetic radiation throughout the entire wavelength range. Consequently, there are also generated signals, which although predicated upon infrared radiation, are not generated by any intruders. Such false alarms must be prevented to the utmost extent possible in any good intrusion monitoring system.

Therefore, attempts have repeatedly been made to find possibilities which safeguard passive infrared detectors against issuing false alarms. In German Pat. No. 2,103,909, published Nov. 25, 1976, there is for instance disclosed such type of monitoring apparatus, wherein an adequate coverage of a particularly large total region or area is obtained by means of only one feeler element or sensor which only then delivers a clear differentiable output signal whenever an intruder moves across the boundary of the covered or monitored region. This is achieved in that a number of reflecting surfaces are arranged such that these reflecting surfaces direct the infrared radiation emanating from a number of mutually separate fields of view upon the feeler element.

To avoid false alarms by electromagnetic radiation which is within a wavelength range which does not correspond to that of a black body (intruder) in a temperature range of 0° C. to 40° C., the radiation inlet window of the infrared detector is covered with an optical filter having a throughpass range of 4 to 20 $\mu$m. Consequently, there is especially blocked visible light. Furthermore, the signal delivered by the feeler or sensor element is amplified by an alternating-current amplifier which is structured such that there are only amplified signals in the frequency range corresponding to the passage of an intruder through the different zones of the region or area to be monitored. This frequency range preferably lies in the order of between 0.1 Hz and 10 Hz.

To detect the presence of intruders in a room or area to be monitored it is necessary to monitor the entire room or area, i.e. both the near region and also the far region, in order to preclude the need for mounting a multiplicity of detectors. In U.S. Pat. No. 3,480,775, granted Nov. 25, 1969, there is disclosed a passive infrared detector, wherein the infrared radiation impinges upon the infrared sensor by means of a substantially cylindrical-shaped fine grid which is arranged about the infrared sensor. Consequently, there is possible an omnidirectional monitoring and a differentiation between background radiation, since a moving body emitting infrared radiation generates an electrical alternating-current signal. To differentiate a moving body emitting infrared radiation from background radiation, the room or area to be monitored is generally divided into fan-like monitoring regions or zones, for instance by means of a zone optical system.

In U.S. Pat. No. 3,829,693, granted Aug. 13, 1974, there is disclosed a passive infrared intrusion detector where thermoelements or thermistors or pyroelectric detectors, serving as the infrared sensors, are arranged in different columns in such a manner that elements of the same column possess the same polarity, yet differ from the polarity of the neighboring columns, so that a moving body emitting infrared radiation generates an alternating-current signal. The infrared detector is provided with two optical systems laving different focal lengths in order to focus the infrared radiation upon the infrared sensor, and wherein, for instance, a mirror arranged behind the infrared detector, and having a larger focal length than a germanium lens arranged forwardly of the infrared detector, which monitors the near region, serves for increasing the far sensitivity.

In European Patent Application No. 25,983, published Apr. 1, 1981, there is disclosed an infrared motion detector or alarm system wherein for the purpose of reducing the sensitivity in relation to electromagnetic radiation which penetrates through glass, an optical filter located forwardly of the inlet of the infrared detector is connected with a heat sink in the form of a solid metal body. This arrangement, while affording a suppression of the secondary infrared radiation source, cannot however prevent the giving of false alarms by heat turbulence in rooms, since such turbulence emits radiation in a range of 4–20 $\mu$m, in other words radiation corresponding to that of intruders.

There are also used in passive infrared detectors differential elements, i.e. the spatial or room zones are imaged upon two closely neighboring sensor elements, for instance two electrodes mounted at the same element, and which are then operatively connected with a differential amplifier. Such type of sensor arrangement has been disclosed, for instance, in U.S. Pat. No. 3,839,640, granted Oct. 1, 1974. In the near region the zones imaged at the individual elements are overlapping, i.e. turbulence generates at both elements the same electrical signals, in other words, the differential amplifier output remains unaffected. By means of such differential elements it is possible to successfully suppress turbulence related which signals are only disturbing if such arise in the near region of the detector. But unfortunately, however, there is also markedly reduced the sensitivity to objects moving in the near range or they cannot be detected at all, quite similar to the case when there occurs turbulence. In other words, intruders which are located close to the detector cannot be detected. Equally, acts of sabotage, such as covering the detector, overspraying the same with a coating material and similar sabotage acts, also cannot be detected.

In European Patent Application No. 23,354, published Feb. 4, 1981, there is disclosed a pyrodetector containing two pyroelectric sensors. One of these pyroelectric sensors is located at the focal point of a hollow mirror or reflector which reflects infrared radiation, whereas the other pyroelectric sensor is located outside of the focal point and serves for the compensation of the infrared radiation which particularly emanates from the cover member.

Room or area monitoring systems operating by means of ultrasound are described in U.S. Pat. No. 4,382,291, granted May 3, 1983, and U.S. Pat. No. 4,499,564, granted Feb. 12, 1985. The room or area monitoring system described in U.S. Pat. No. 4,499,564 like the room or area monitoring described in U.S. Pat. No. 4,382,291, forms a plurality of reference patterns in the normal state of the room or area to be monitored and computes and stores a statistic evaluation of the reference patterns based on the mean value and the standard deviation at predetermined sampling points. An actual monitoring pattern is compared with the statistic evaluation of the reference pattern at the same sampling points. An alarm is generated when the actual monitoring pattern at one of the sampling points deviates from the mean value determined for the reference patterns by more than the standard deviation also computed from the reference patterns.

The room or area monitoring system according to U.S. Pat. No. 4,382,291 does not include measures for suppressing faulty alarms. The room or area monitoring system according to U.S. Pat. No. 4,499,564 attempts to suppress faulty alarms which are due to predetermined noise sources like, for example, a telephone bell or the bell of a fire alarm. Other noise sources like, for example, radio or television loudspeakers, heat turbulences due to heaters, insolation or wind movements, cannot be suppressed so that faulty alarms still occur. The aforementioned systems do not offer a solution for the problem of protection against sabotage, i.e. the covering of the ultrasound sensors by means of adhesive tapes or sprayed-on paints.

While the different known measures for suppressing false alarms are indeed effective, nonetheless they only encompass and deal with a part of the problem of detectors issuing false alarms, and in particular the sabotage problem. This last-mentioned problem is particularly concerned with the intentional covering of the inlet window of the detector with an object, for instance a hat or board, or by spraying-on a transparent lacquer or varnish which absorbs the infrared radiation in the wavelength range of 4–20 $\mu$m which is required for the detection of intruders. In this way it is possible to render the detector so-to-speak "blind", and thus, intruders which unlawfully enter the monitored region or room no longer can be detected.

A further problem which has not yet been described in the relevant publications resides in the fact that present day passive infrared detectors must possess a signal-to-noise ratio (S/N) of approximately 10 before the detector can give an alarm. This signal-to-noise ratio had to be selected to be so large, in order that there could be reduced the number of false alarms which were caused by the noise of the detector. A signal-tc-noise ratio S/N of approximately 10 is, however, associated with quite appreciable drawbacks as concerns the detection of intruders, since the signal produced by the object is proportional to the temperature difference between the object and the background. Additionally, the signal of the presently employed pyroelectric sensor elements is proportional to the speed with which the object moves through the room or area to be monitored. Because of this high signal-to-noise ratio which is needed for suppressing false alarms it is difficult to detect intruders who move very slowly and/or who reduce the temperature difference between themselves and the surroundings, for instance by wearing suitable clothes.

SUMMARY OF THE INVENTION

Therefore, with the foregoing in mind it is a primary object of the present invention to provide a new and improved construction of a passive infrared detector which is not afflicted with the aforementioned drawbacks and shortcomings of the prior art proposals.

Another and more specific object of the present invention aims at avoiding the drawbacks of the state-of-the-art passive infrared detectors and devising a passive infrared detector having increased reliability, in other words, increased detection probability with reduced susceptibility to giving false alarms.

A further important object of the present invention deals with the provision of a new and improved construction of a passive infrared detector, the electrical circuitry of which enables suppression of false alarms which are produced by thermal turbulence and electronic noise, and also permits the detection of slowly moving objects having small temperature differences in relation to the background.

Yet a further significant object of the present invention is directed to the provision of a new and improved construction of a passive infrared detector, the evaluation circuitry of which generates useful evaluatable signals which enables setting the alarm threshold considerably below the heretofore employed signal-to-noise ratio of about 10, without affecting the suppression of false alarms.

A further noteworthy object of the present invention is directed to a new and improved construction of a passive infrared detector at which there can be reliably ascertained acts of sabotage, such as covering the inlet optical system with a material which is impervious to infrared radiation, for instance paper, glass or spray lacquers or varnishes or the like, and wherein there can be generated signals which can be clearly differentiated from warm air turbulence.

A further important object of the present invention is directed to a new and improved passive infrared detector which is relatively simple in construction and design, quite economical to manufacture, extremely reliable in operation, not readily to breakdown or malfunction, requires very little servicing and maintenance, and is not prone to giving off false alarms.

Now in order to implement these and still further objects of the invention, which will become more readily apparent as the description proceeds, the passive infrared detector of the present development is manifested by the features that the output signal of the infrared detector is not only evaluated with respect to its amplitude but also with regard to its similarity to a reference or set signal. To that end, there are stored reference or set signals in a read-only memory (ROM) which essentially correspond to the signals generated by an object which moves at different speeds or velocities through the monitoring region or area of the optical system. Each signal of the infrared detector is then correlated with the reference or set signals and an alarm is then triggered when the similarity with one or more reference signals exceeds a predetermined value and at the same time the amplitude is greater than a fixed threshold value. Since high similarities also arise even in the case of input signals having a great deal of noise, in other words signals having a signal-to-noise ratio of approximately 1, there is thus obtained a decisive improvement of the detection probability.

According to a preferred construction of the inventive passive infrared detector the reference or set signal is obtained by a second optical system, the monitoring region of which is different from that of the first optical system, in conjunction with a second sensor element. This second optical system preferably monitors only the near region of the detector.

According to a preferred embodiment of the inventive passive infrared detector the second sensor element possesses an optical system, the focal length of which is selected such that the near region (i.e. housing, window) is imaged at such second sensor element in contrast to the first optical system which images upon the first sensor element objects which are located at a far distance.

According to a further preferred embodiment of the inventive passive infrared detector the second optical system comprises apertured diaphragms or mirror segments, which cause the monitoring regions to intersect or overlap only in the immediate vicinity of the detector.

According to a further preferred embodiment of the inventive passive infrared detector the comparison is only accomplished with fixedly stored reference or set signals or functions, in order to obtain an increase or enhancement in the detection probability. For the suppression of the turbulence there is employed a differential sensor element. In this case there is rendered superfluous the use of a second sensor element.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components and wherein.

DETAILED DESCRIPTION OF THE PREFERRED EMBODIMENTS

Figure 1:
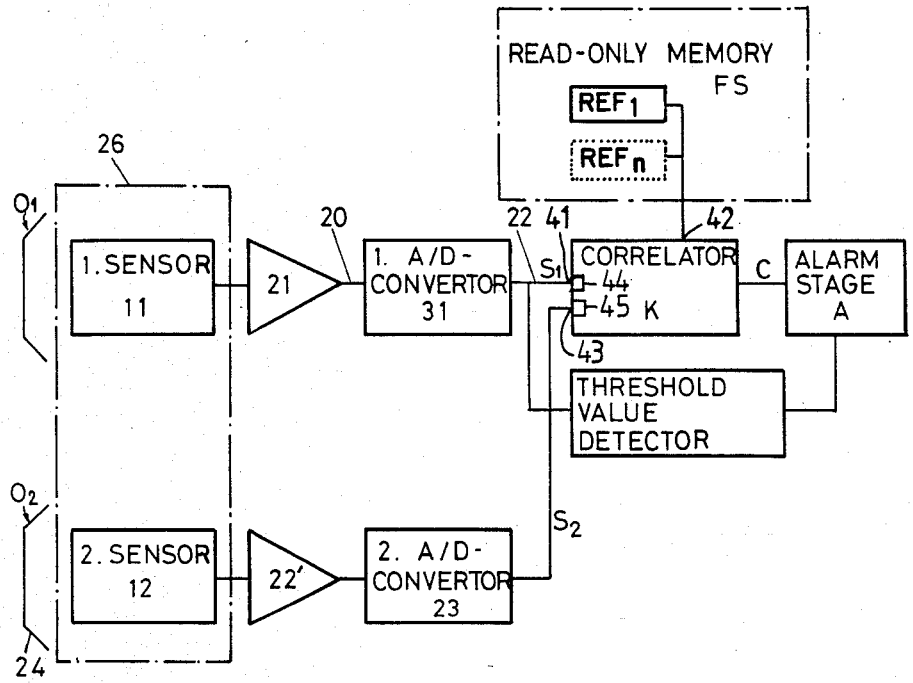
FIG. 1 is a block circuit diagram of a first exemplary embodiment of the inventive passive infrared detector.

Describing now the drawings, it is to be understood that only enough of the construction of the passive infrared detector or alarm system and its related circuitry has been shown as needed for those skilled in the art to readily understand the underlying principles and concept of the present development, while simplifying the showing of the drawings. Turning attention now to FIG. 1, there is illustrated therein in block circuit diagram a passive infrared intrusion detector which comprises a first sensor or feeler element 11 which is impinged with infrared radiation emanating from a monitored room or area, for example, the far region, and imaged upon the first sensor or feeler element 11 by means of a first optical system $O_1$ which has a predetermined focal length and is of conventional construction. Furthermore, the passive infrared detector or alarm system contains a second sensor or feeler element 12 which is impinged with infrared radiation emanating from a second monitored region or area, for example, the near region and imaged upon the second sensor or feeler element 12 by means of a second optical system $O_2$ which is directed to such near region.

The aforementioned first sensor element 11 delivers an electrical signal as a function of the level of the infrared radiation impinging thereat, and this signal is then appropriately amplified by a first amplifier 21. The amplified signal is inputted into a first analog-to-digital converter 31 (A/D-converter) which transforms the analog signal appearing at its input 20 into a digital first actual monitoring signal $S_1$ and infeeds such digital signal from its output 22 to a first input 41 of a suitable correlator or correlator circuit K constituting part of a microprocessor, for example, of the type INTEL 8048. The correlator K has a second input 42 at which reference or set signals or functions $REF_1 \ldots REF_N$ are supplied to the correlator K from a read-only memory FS in which such reference or set signals or functions $REF_1 \ldots REF_N$ are stored. The correlator K further contains a third input 43 and receives at this third input 43 digital second actual monitoring signals $S_2$ which originate from the second sensor element 12. Depending upon the level of the impinging infrared radiation, which is imaged upon the second sensor element 12 by means of the second optical system $O_2$, the second sensor element 12 delivers an electrical analog signal which is amplified by means of a second amplifier 22' and converted into the digital second actual monitoring signal $S_2$ by means of a second analog-to-digital converter 23.

The digital first actual monitoring signal $S_1$ appearing at the output 22 of the A/D-converter 31, is also inputted to a threshold value detector where there is determined the value of the signal amplitude.

The correlator K and the threshold value detector have arranged thereafter a suitable alarm stage A which delivers an alarm signal as a function of a correlation or correlation factor C which is determined by the correlator K, as well as the amplitude of the first actual monitoring signal $S_1$.

The aforementioned correlation or correlation factor C which is determined for the actual monitoring signals in relation to the predetermined reference or set signals or functions $REF_1 \ldots REF_N$, is computed by means of a correlation equation (1) which will be explained in more detail hereinbelow, in the correlator K by means of the aforementioned microprocessor, for example, of the type INTEL 8048. This will now be explained with reference to the first exemplary embodiment of the inventive passive infrared detector or alarm system which is illustrated in FIG. 1.

It will be assumed that the first optical system $O_1$ images upon the first sensor element 11 events like, for example, slow and rapid movements of objects or bodies, warm air turbulences and the like which originate from the far region of the passive infrared detector. The first actual monitoring signals $S_1$ which result therefrom and which originate from the aforementioned far region, arrive at the first input 41 of the correlator K. All a.c. components contained in the thus inputted first actual monitoring signals $S_1$ are removed in an associated first input circuit 44 of the correlator K.

Figure 3:
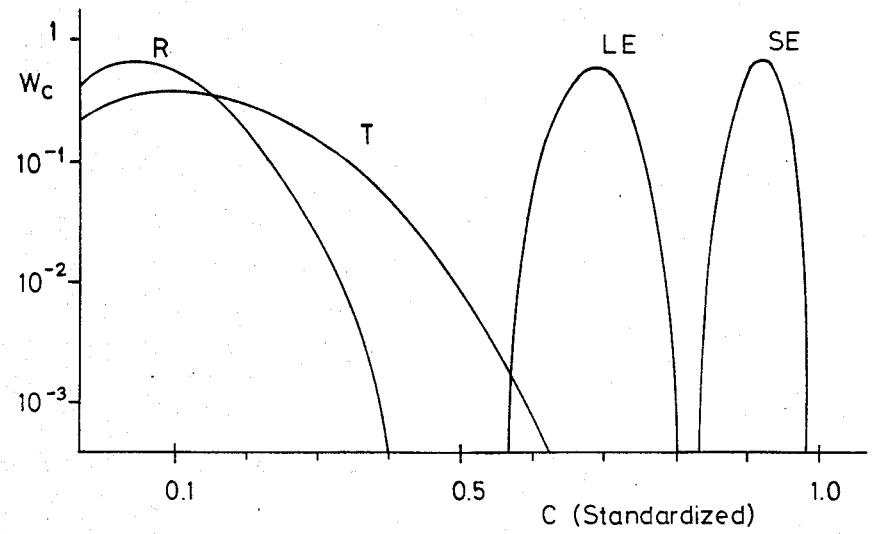
FIG. 3 are graphs illustrating the occurrence probability of a predetermined correlation or similarity of a signal occurring at the infrared detector with one of the stored reference or set signals or functions for different events.

The aforementioned first actual monitoring signals $S_1$ are ccmpared in the correlator K with the reference signals or functions $REF_1 \ldots REF_N$ which are stored in the read-only memory FS and which represent different speeds of movement. The comparison is carried out using sampled first actual monitoring signals $S_1$ which are sampled at predetermined moments of time, for example, every 50 milliseconds, on the basis of the correlation or correlation factor C computed by means of the correlation equation (1). When the correlation or correlation factor C computed by means of the correlation equation (1) exceeds a predetermined value, for example, of 0.7 and simultaneously a predetermined threshold value of the amplitude of the first actual monitoring signal $S_1$ is exceeded in the threshold value detector, an alarm signal is generated by means of the alarm stage A. Such alarm signal may be of an acoustical and/or optical nature. The computed correlation or correlation factor C between the first actual monitoring signals $S_1$ and the reference signals or functions $REF_1 \ldots REF_N$ is provided for detecting events which are classified as intrusions. The relationship is illustrated in FIG. 3 and will be explained in more detail hereinafter.

Furthermore, the correlator K is organized such that there can be compared with the reference signals or functions $REF_1 \ldots REF_N$ at the same sampling moments of time, for example, every 50 milliseconds, sampled second actual monitoring signals $S_2$ which are related to the near region of the passive infrared detector and which are generated by the second sensor element 12 by means of the second optical system $O_2$ which is directed to such near region. The second actual monitoring signals $S_2$ are inputted into the correlator K at the third input 43 of the correlator K. Any a.c. voltage components are removed from the thus inputted second actual monitoring signals $S_2$ in an associated second input circuit 45 of the correlator K. When the correlation or correlation factor C computed by means of the correlation equation (1), exceeds a predetermined value, for example, of 0.7 an acoustical and/or optical alarm is generated by means of the alarm stage A. In the exemplary embodiment illustrated in FIG. 1, the amplitude level of the second actual monitoring signals $S_2$ is not considered for generating the alarm signal. However, in a modified embodiment, the threshold value detector may also be constructed for monitoring the amplitude of the second actual monitoring signals $S_2$. The computed correlations or correlation factors C between the second actual monitoring signals $S_2$, which originate from the near region of the passive infrared detector, and the reference signals or functions $REF_1 \ldots REF_N$ are intended for monitoring events which are classified as intrusions in the near region of the passive infrared detector. This is also illustrated in FIG. 3 which will be explained in more detail hereinbelow.

The correlator K is further organized such that the first actual monitoring signals $S_1$, which originate from the far region of the passive infrared detector, can be compared or correlated with the second actual monitoring signals $S_2$ which originate from the near region of the passive infrared detector. Such comparison or correlation is carried out using the sampled signals which are sampled at the same moments of time, for example, every 50 milliseconds, on the basis of the correlation or correlation factor C computed by means of the correlation equation (1). The input circuits 44 and 45 respectively associated with the first input 41 and with the third input 43 of the correlator K eliminate a.c. voltage components from the first and second actual monitoring signals $S_1$ and $S_2$. In the presently described mode of operation, the second actual monitoring signals $S_2$ are utilized as reference signals or functions instead of the reference signals or functions $REF_1 \ldots REF_N$ which are received from the read-only memory FS. When the correlation or correlation factor C computed by means of the correlation equation (1) exceeds a predetermined value, for example, of 0.7 and simultaneously the first actual monitoring signal $S_1$ exceeds a predetermined threshold value in the threshold value detector, an acoustical and/or optical alarm is generated in the alarm stage A. The computed correlations or correlation factors C between the first actual monitoring signals $S_1$, which originate from the far region of the passive infrared detector, and the second actual monitoring signals $S_2$, which originate from the near region of the passive infrared detector and which now constitute reference signals or functions, are intended for detecting events which are classified as sabotage S and interferences like, for example, warm air turbulences T which appear in the near region and in the far region of the passive infrared detector.

Consequently, the second actual monitoring signals $S_2$ have a double function. They constitute actual monitoring signals as well as reference signals or functions.

Figure 4:
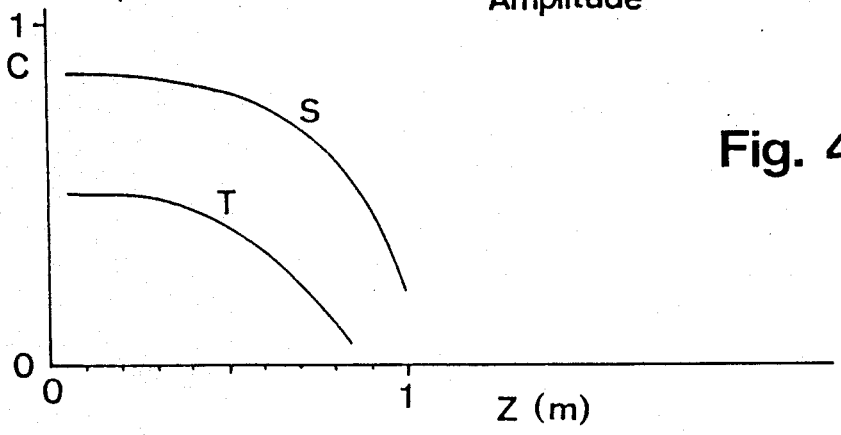
FIG. 4 are graphs illustrating the correlation or similarity between the signals which are produced by both of the different optical systems for different events, as a function of distance from the detector.
Figure 5:
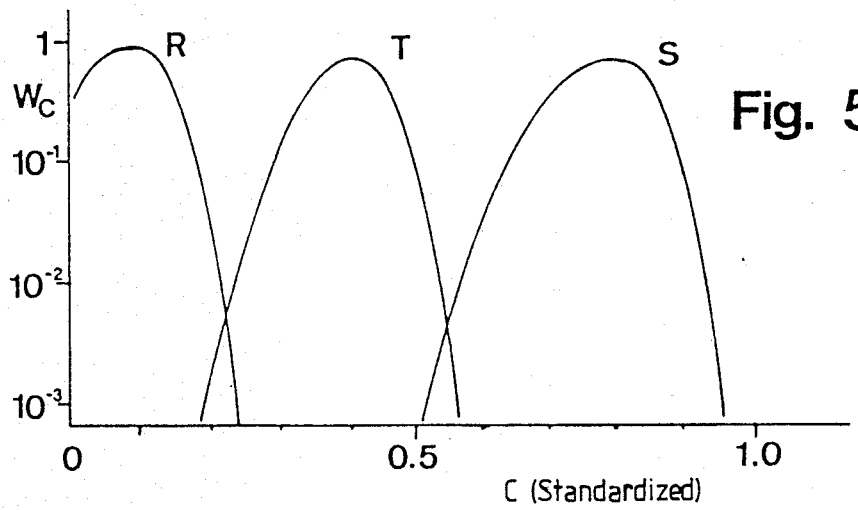
FIG. 5 is a graph illustrating the occurrence probability of a predetermined correlation or similarity between the signals produced by both of the different optical systems for different events.

The aforedescribed three types of correlations or correlation factors C which are simultaneously or successively computed in accordance with the correlation equation (1) by means of the correlator K of the microprocessor, permit effective discrimination between events which are classified as intrusion and sabotage S (for example, covering or spraying the optical systems $O_1$ and $O_2$) as well as effective discrimination between such events and interferences or disturbances like electronic noise R and warm air turbulences T. Thus, the alarm is generated free of faulty alarms and in a manner which is specific for the event which initiates the alarm. This implies that the electronic circuit as illustrated in FIG. 1 generates an alarm for the class of events related to intrusion and such alarm is different from the alarm generated for the class of events related to sabotage S. Furthermore, from computing the correlation or correlation factor C there results the advantage that such effective discrimination is also ensured in the case of first and second actual monitoring signals $S_1$ and $S_2$ having extremely poor signal-to-noise ratios of, for example, S/N similar to 1. Such signals containing high-level noise cannot be evaluated using known infrared detectors because the useful signal is totally buried in the noise. These conditions are also illustrated in FIGS. 3, 4 and 5 which will be explained further hereinbelow.

Typically, an object which moves through a monitored or supervised region, generates a sequence of positive and negative signal pulses. For instance, the positive-going pulses are representative of movements of the object into the monitored zone and the negative-going pulses are representative of movements of the object out of the monitored zone. The amplitude and duration or width of the pulses are dependent upon the movement velocity of the object and the temperature difference between the object and the background. As the reference or set signals or functions $REF_1 \ldots REF_N$ there can be selected pulse trains or sequences which, for instance, correspond to different typical speeds of movement. However, it is also sufficient to use idealized reference or set signals or functions $REF_1 \ldots REF_N$, for instance, successive square wave pulses or pulses which possess the known Gaussian waveform.

The aforementioned reference signals or functions $REF_1 \ldots REF_N$ may have different durations or widths. For example, the following five reference signals or functions can be used and constitute square wave pulses. The amplitudes of such square wave pulses change between the values of +1 and −1. The referred-to duration is always related to the period of one square wave pulse. The selected square wave pulses are as follows:

$REF_1$: duration 200 milliseconds
$REF_2$: duration 400 milliseconds
$REF_3$: duration 800 milliseconds
$REF_4$: duration 1.6 seconds
$REF_5$: duration 3.2 seconds These simple reference signals or functions $REF_1 \ldots REF_5$ are defined or selected in such a manner that the period of each successive reference signal or function has twice the duration as the preceding reference signal or function. For reasons of simplicity only five reference signals or functions $REF_1 \ldots REF_5$ are selected.

It will be self-evident that the time duration of the periods of the individual reference signals or functions as well as the number of reference signals or functions can be selected in any other suitable manner different from the aforementioned reference signals or functions $REF_1 \ldots REF_5$.

Figure 7:
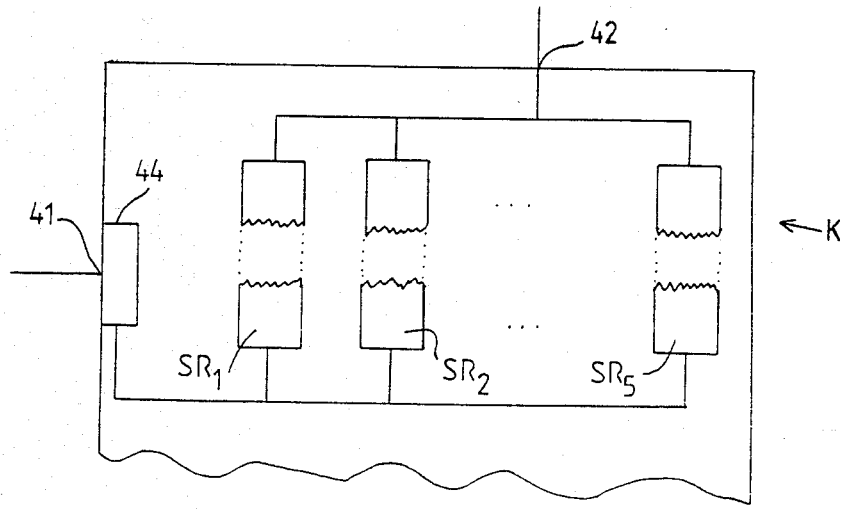
FIG. 7 is a schematic illustration of a portion of the correlator shown in FIGS. 1 and 6.

The aforementioned correlating operation involves, for example, the comparison of the incoming first actual monitoring signals $S_1$ which are sampled every 50 msec, with the reference signals or functions $REF_1 \ldots REF_5$ which are stored in the read-only memory FS. This comparison is carried out in the illustrated exemplary embodiment in the following manner:

At the start of the operation, the reference signals or functions $REF_1 \ldots REF_5$ are loaded into fixed locations of related shift registers $SR_1 \ldots SR_5$ in the correlator K (see FIG. 7). Each such reference signal or function is composed of a predetermined number of samples at predetermined sampling intervals which correspond to the sampling intervals of the first actual monitoring signals $S_i$. The predetermined number of samples is selected such that a correlation can be computed for the range of occurring actual monitoring signals and a total of 64 samples has proven sufficient in the presently described embodiment.

During actual operation, the samples or sampled values of the first actual monitoring signal $S_1$ are fed in parallel into the shift registers $SR_1 \ldots SR_5$. Consequently, there exists a time shift between the infed samples and the fixedly stored samples of the reference signals or functions $REF_1 \ldots REF_5$ in each shift register $SR_1 \ldots SR_5$ and this time shift changes by 50 msec with each infed sample. The correlating operation basically constitutes a comparison of the shape of the intruder-related signal pulse or curve, which is determined by the variation of the first actual monitoring signal $S_1$ as a function of time $\lambda$, with the shape, i.e. the variation of each reference signal or function $REF_1 \ldots REF_5$ with an offset time $t-\lambda$ wherein t denotes the temporal offset between the samples of the two signals under comparison. In such case, a correlation factor C can be computed according to the equation $$C = \int_{-\infty}^{+\infty} S_i(\lambda) \cdot REF_i(t-\lambda)\, d\lambda \qquad (1)$$

wherein $S_i$ and $REF_i$ are the actual monitoring signals and the reference signals, respectively, $\lambda$ the integration variable, namely time, and t the temporal shift or offset between the actual monitoring signal sample and the associated reference signal sample.

This equation is known for the computation of the correlation between the received waveform and the output waveform of a so-called matched filter which produces a maximum output at a time delay corresponding to the phase shift between the received waveform and the output waveform, see the textbook by M. I. Skolnik, entitled "Introduction to Radar Systems", published 1980 by McGraw-Hill Book Company, pages 369 to 375, particularly page 373, eq. 10.16.

For practical purposes, particularly with the view of obtaining correlation factors C which are independent of the signal energy, standardized correlation factors $C_{St}$ are computed in accordance with the following equation $$C_{St} = \frac{\int_{-T_o/2}^{+T_o/2} S_i(\lambda) \cdot REF_i(t-\lambda)\, d\lambda}{\left\{ \int_{-T_o/2}^{+T_o/2} S_i^2(\lambda)\, d\lambda \cdot \int_{-T_o/2}^{+T_o/2} REF_i^2(\lambda)\, d\lambda \right\}^{\frac{1}{2}}}$$

wherein $S_i$ represents the digital actual monitoring signals which may be either one of the first and second actual monitoring signals $S_1$ and $S_2$, $REF_i$ the reference signal or function which may be either one of the reference signals or functions $REF_1 \ldots REF_N$, $\lambda$ the integration variable, namely time, $-T_o/2$, $+T_o/2$ the integration limits which are selected such that all occurring actual monitoring signals $S_i$ are reliably encompassed by the computation, and t the the delay or offset between the actual monitoring signal $S_i$ and the reference signal or function $REF_i$.

From the foregoing description it will be apparent that the digital second actual monitoring signal $S_2$ also can be utilized as a reference signal; in that case $REF_i$ in the correlation equation (1) would be substituted by $S_2$.

It will be apparent from the foregoing explanations that the computed standardized correlation or correlation factor $C_{St}$ increases with increasing similarity between the actual monitoring signal $S_i$ and the individual reference signals or functions $REF_i$. The alarm stage A is activated at any time at which the amplitude of the first actual monitoring signal $S_1$ and the standardized correlation or correlation factor $C_{St}$ determined for the correlation between the first actual monitoring signal $S_1$ and one of the reference signals or functions $REF_i$ exceeds a predetermined value as well as at any time at which the standardized correlation or correlation factor $C_{St}$ determined for the correlation between the second actual monitoring signal $S_2$ and one of the reference signals or functions $REF_1 \ldots REF_5$ exceeds a predetermined value.

Figure 2:
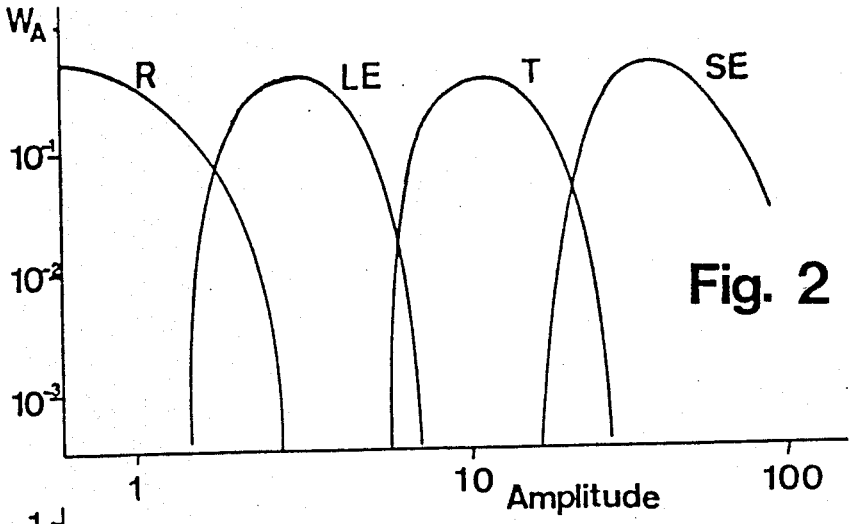
FIG. 2 are graphs illustrating the occurrence probability of a predetermined amplitude for different events.

The obtained results have been graphically portrayed in FIGS. 2 and 3. In FIG. 2 there is plotted in logarithmic representation the measured occurrence probability $W_A$ of a certain amplitude A (in relative units) for different first actual monitoring signals $S_1$ delivered by the first sensor element 11. The value $W_A$ of the occurrence probability is experimentally determined by repeatedly measuring the signals due to different nominal equal events. $W_A$ then designates the probability that a predetermined signal appears at the occurrence of a predetermined event. In the graphic representation of FIG. 2 the reference characters represent the following events: R=electronic noise; LE=object walking with a slow velocity, small temperature contrast to the surroundings; T=turbulence in the near region; SE=object walking with a normal velocity, temperature contrast $\Delta T$ with respect to the background=2°.

It will be apparent therefrom that with the heretofore conventional alarm threshold of S/N=10 the detection probability is insufficient and that there still exists a high false alarm probability due to warm air turbulence. In particular, however, there could not be detected intruders moving with a small velocity and possessing a small temperature difference to the surroundings.

In the graph of FIG. 3 there has been plotted the measured occurrence probability $W_C$ associated with a maximum value of the standardized correlation or correlation factor $C_{St}$ between the first actual monitoring signal $S_1$ and the stored reference signals or functions $REF_1 \ldots REF_N$—the greater the values of $C_{St}$ that much greater is the similarity of the first actual monitoring signal $S_1$ with the stored reference signal or function $REF_1 \ldots REF_N$. As will be apparent from the illustration of FIG. 3, the signals caused by an actual intrusion are shifted to large similarity values and separated from the false alarms.

If the turbulence should be more intensively suppressed, then, there can be used a differential detector which suppresses the signals emanating from the near region. In this manner there can be obtained an extremely high suppression of false alarms with markedly increased detection probability so that intruders with small moving velocities and small temperature differences to the background can now be detected, if the alarm threshold is set, for instance, in its amplitude to a value of S/N=2 and in its similarity to a standardized correlation value or factor $C_{St}=0.7$. For this purpose there are particularly also suitable differential sensors of the type disclosed in the commonly assigned, copending U.S. application Ser. No. 06/466,106, filed Feb. 14, 1983, and entitled "Infrared Intrusion Detector Containing a Photoelectric Radiation Receiver", now abandoned, the disclosure of which is incorporated herein by reference, and which are unbalanced for high frequencies. Such differential sensors are also described in the cognate European Patent Publication No. 0,086,369.

Turning attention now to FIGS. 4 and 5 there will be explained with reference thereto the function when there is provided as the reference signal or function, the second actual monitoring signal $S_2$ which emanates from the second sensor element 12 equipped with the second optical system $O_2$ which, for example, contains an apertured diaphragm 24, which ensures that the monitoring regions of both the first and second sensor elements 11 and 12 only overlap in the immediate vicinity of the detector i.e. close to the detector. As already explained, this signal is likewise initially amplified by the second amplifier 22' and then converted by the second analog-to-digital converter 23 into digital form. The second actual monitoring signal $S_2$ is then inputted as a reference signal or function to the correlator K.

This correlator K then forms the standardized correlation or correlation factor $C_{St}$ between the first actual monitoring signal $S_1$ obtained from the first sensor element 11 and the second actual monitoring signal $S_2$ which is obtained from the second sensor element 12 and constitutes the reference signal or function.

In the graph of FIG. 4 there is plotted the standardized correlation or correlation factor $C_{St}$ which is representative of the similarity between the first and second actual monitoring signals $S_1$ and $S_2$ as a function of the distance Z from the passive infrared detector for two different events, such as covering the detector with a material which is not transparent to infrared radiation, in other words a sabotage act or event S, and warm air turbulence T. As will be apparent from FIG. 4, the standardized correlation or correlation factor $C_{St}$ or similarity only attains high values in the immediate vicinity of the detector or alarm system and the $C_{St}$-values are different for both events S and T.

In the graph of FIG. 5 there has been plotted for purposes of further explaining such subject matter the occurrence probability $W_C$ for the standardized correlation or correlation factor $C_{St}$ or similarity between the first and second actual monitoring signals $S_1$ and $S_2$ for different events. In this graph the reference characters have the following meanings: R=electronic noise and/or passing through the monitoring region at a large distance from the detector; T=warm air turbulence, and S=covering, overspraying in the near region (sabotage act or event).

As will be apparent from the showing of FIG. 5, there occur three similarity regions which render possible a differentiation of the events and thus an identification of an act of sabotage.

Instead of the element 24 constituting an apertured diaphragm this element 24 also may comprise mirror elements. Furthermore, both of the first and second sensor elements 11 and 12 may be arranged upon a chip or may be provided in a common housing, as has been schematically indicated by reference character 26 in FIG. 1. Equally, the first and second optical systems $O_1$ and $O_2$ may be structured in conventional manner such that they monitor the room or area to be supervised in a number of active zones, and the second optical system $O_2$ of the second sensor element 12 is structured such that it only images a conventional radiation inlet window. Also, a standardized correlation factor $C_{St}$ of approximately 0.35 may serve as a predetermined first threshold value for the correlation between the first and second actual monitoring signals $S_1$ and $S_2$ received from the first sensor element 11 and the second sensor element 12, respectively, for generating a disturbance signal whereas a predetermined threshold value of 0.7 for this correlation may serve as a threshold value for generating an alarm signal.

Figure 6:
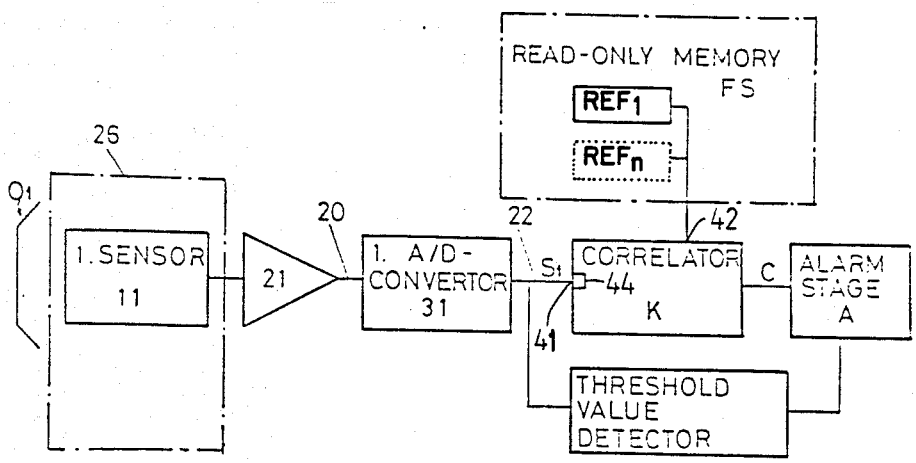
FIG. 6 is a block circuit diagram of a second exemplary embodiment of the inventive passive infrared detector.

A second exemplary embodiment of the inventive passive infrared detector is illustrated in FIG. 6. This second exemplary embodiment contains the same elements or components as the first embodiment described hereinbefore with reference to FIG. 1 with the exception of one of the two sensor elements 11 and 12, in the specifically illustrated example the second sensor element 12 and its associated components. As described hereinbefore with reference to FIG. 1, there are present the sensor or feeler element 11 and the optical system $O_1$ which images the monitored room or area upon such sersor or feeler element 11. The electrical signal generated by the sensor or feeler element 11 is amplified by the amplifier 21 and converted into digital actual monitoring signals $S_1$ by the A/D converter 31. The digital actual monitoring signals $S_1$ are supplied to the correlator K which is connected with the read-only memory FS, and to the threshold value detector. The correlator K and the threshold value detector are connected to the alarm stage A. The operation of this system is the same as described hereinbefore with reference to FIGS. 1 to 3. This second embodiment thus does not have the additional monitoring facilities which are offered by the first embodiment due to the presence of the second sensor element 12 and its associated components and which are described hereinbefore with reference to FIGS. 4 and 5. In analogous manner, when the first sensor element 11 is eliminated from the passive infrared detector illustrated in FIG. 1, the second embodiment of the inventive infrared detector would not have the monitoring facilities associated with such first sensor element 11 and its associated components.

While there are shown and described present preferred embodiments of the invention, it is to be distinctly understood that the invention is not limited thereto, but may be otherwise variously embodied and practiced within the scope of the following claims.

Accordingly, what we claim is:

1. A passive infrared detector for determining the presence of an intruder possessing a temperature differing from the ambient temperature, comprising:

at least one sensor element generating an electrical signal as a function of infrared radiation impinging upon said at least one sensor element;

at least one optical system for focusing the infrared radiation upon said at least one sensor element;

said at least one optical system imaging infrared radiation upon said at least one sensor element which infrared radiation emanates from a number of predetermined separate fields of view;

an evaluation circuit operatively connected with said at least one sensor element and delivering an output signal dependent upon changes in the impinging radiation;

said evaluation circuit comprising:

a correlator; and storage means for storing a predetermined number of reference signals which are representative of typical movement patterns of intruders;

said correlator correlating by means of a correlation method said electrical signals generated by said at least one sensor element with said reference signals stored in said storage means;

said correlator delivering an output signal corresponding to the correlation of the electrical signal generated by said at least one sensor element and the reference signals; and said evaluation circuit further comprising an alarm stage arranged in circuit after the correlator for delivery an alarm signal when the correlation between the electrical signal generated by said at least one sensor element and at least one of said stored reference signals as well as the amplitude of said electrical signal simultaneously exceed a predetermined value.

2. The infrared detector as defined in claim 1, wherein:

said storage means comprises a read-only memory.

3. The infrared detctor as defined in claim 2, wherein:

said reference signals correspond to different speeds of movements of intruders.

4. The infrared detector as defined in claim 1, wherein:

said at least one sensor element comprises a first and second sensor element;

said at least one optical system comprises a first and second optical system, said second optical system focusing radiation upon said second sensor element;

both of said optical systems being structured such that monitoring regions thereof overlap only in the immediate vicinity of the detector;

said correlator being operatively connected to said storage means, to said first sensor element and to said second sensor element; and said correlator being structured and operable such that it selectively compares the electrical signals obtained from the first sensor element with any one of either (i) said reference signals stored in the storage means or (ii) electrical signals generated by the second sensor element.

5. The infrared detector as defined in claim 4, wherein:

said second optical system contains imaging means imaging a region near the infrared detector on said second sensor element; and said alarm stage is structured such that it delivers a disturbance signal when the correlation between the electrical signals received from the first sensor element and the electrical signals received from the second sensor element exceeds a preset first threshold value based upon a variation in the occuurence probability of a correlation signal as a function of the magnitude of said correlation.

6. The infrared detector as defined in claim 5, wherein:

said preset first threshold value amounts to approximately 0.35.

7. The infrared detector as defined in claim 4, wherein:

said second optical system contains imaging means imaging a region near the infrared detector on said second sensor element; and said alarm stage is structured such that it delivers an alarm signal when the correlation between the electrical signals received from the first sensor element and the electrical signals received from the second sensor element exceeds a preset second threshold value based upon a variation in the occurrence probability of a correlation signal as a function of the magnitude of said correlation.

8. The infrared detector as defined in claim 7, wherein:

said preset second thereshold value amounts to approximately 0.7.

9. The infrared detector as defined in claim 4 wherein:

both of said first and second sensor elements are located upon a chip.

10. The infrared dector as defined in claim 4, further including:

a common housing means for both of said sensor elements.

11. The infrared detector as defined in claim 1, wherein:

said predetermined value for the correlation between the electrical signal generated by the at least one sensor element and the at least one stored reference signal amounts to approximately 0.7 based upon a variation in the occurrence probability of a correlation signal as a function of the magnitude of said correlation; and said predetermined value for the amplitude of said electrical signal amounts to approximately twice the RMS-value of the noise.

12. The infrared detector as defined in claim 1, wherein:

said correlator comprises a predetermined number of shift registers;

each one of said shift registers containing a fixed location at which one of said reference signals is stored;

said at least one sensor element being operatively connected to at least one analog-to-digital converter which converts the electrical signal generated by the at least one sensor element into at least one digital actual monitoring signal;

said predetermined number of shift registers being connected parallel to said at least one sensor element and receiving said at least one digital actual monitoring signal at a predetermined temporal offset from the reference signals stored at said fixed locations in said shift registers; and said correlator correlating said at least one digital actual monitoring signal and said reference signals stored at said fixed locations of said shift registers in accordance with the relationship $$C_{St} = \frac{\int_{-T_o/2}^{+T_o/2} S_i(\lambda) \cdot REF_i(t-\lambda)d\lambda}{\left\{ \int_{-T_o/2}^{+T_o/2} S_i^2(\lambda)d\lambda \cdot \int_{-T_o/2}^{+T_o/2} REF_i^2(\lambda)d\lambda \right\}^{\frac{1}{2}}}$$

wherein:

$S_i$ represents the digital actual monitoring signal, $REF_i$ the reference signal stored at the fixed location of one of the shift registers, $\lambda$ the integration variable, namely time, t the temporal offset between the digital actual monitoring signal and the reference signal stored at the fixed location of the one shift register, and $-T_o/2$, $+T_o/2$ the integration limits.

* * * * *

UNITED STATES PATENT AND TRADEMARK OFFICE

CERTIFICATE OF CORRECTION

PATENT NO. : 4,746,910

DATED : May 24, 1988

INVENTOR(S) : GUSTAV PFISTER et al

It is certified that error appears in the above-identified patent and that said Letters Patent is hereby corrected as shown below:

Column 7, line 30, after "are" please delete "ccmpared" and insert --compared--

Column 13, line 23, please delete "sersor" and insert --sensor--

Column 14, line 57, please delete "occuurence" and insert --occurrence--

Column 15, line 17, please delete "dector" and insert --detector--

Signed and Sealed this

Twenty-seventh Day of September, 1988

*Attest:*

DONALD J. QUIGG

*Attesting Officer*

*Commissioner of Patents and Trademarks*